US006108915A

United States Patent [19]

Verdier et al.

[11] Patent Number: 6,108,915

[45] Date of Patent: Aug. 29, 2000

[54] MICROTOOTHING FOR THE BLADE OF A CUTTING IMPLEMENT, PARTICULARY A KNIFE

[76] Inventors: Aubry Verdier, Frissonnet, 63120 Sainte-Agathe; Ronan Verdier, La Bergère, 63250 Celles-sur-Durolle, both of France

[21] Appl. No.: 08/945,284

[22] PCT Filed: Apr. 10, 1996

[86] PCT No.: PCT/FR96/00536

§ 371 Date: Oct. 14, 1997

§ 102(e) Date: Oct. 14, 1997

[87] PCT Pub. No.: WO96/32231

PCT Pub. Date: Oct. 17, 1996

[30] Foreign Application Priority Data

Apr. 13, 1995 [FR] France ..... 95 04696

[51] Int. Cl.[7] ..... B26B 9/02

[52] U.S. Cl. ..... 30/355; 30/357

[58] Field of Search ..... 30/355, 357, 356

[56] References Cited

U.S. PATENT DOCUMENTS

| | | | |
|---|---|---|---|
| 1,388,547 | 8/1921 | Burns | 30/355 |
| 2,059,414 | 11/1936 | Taylor | 30/355 |
| 2,555,735 | 6/1951 | Estabrooks | 30/355 |
| 3,024,533 | 3/1962 | Nitsch | 30/355 |
| 4,907,344 | 3/1990 | Hahn | 30/355 |
| 5,787,591 | 8/1998 | Lu | 30/355 |

FOREIGN PATENT DOCUMENTS

| | | | |
|---|---|---|---|
| 0220362 | 5/1987 | European Pat. Off. . | |
| 605974 | 6/1926 | France . | |
| 8913469 | 9/1990 | Germany . | |
| 257465 | 9/1926 | United Kingdom . | |
| 391947 | 5/1933 | United Kingdom . | |
| 2108887 | 5/1983 | United Kingdom | 30/355 |

*Primary Examiner*—Hwei-Siu Payer
*Attorney, Agent, or Firm*—Horst M. Kasper

[57] ABSTRACT

Cutlery is disclosed having a relief of a blade of a cutting tool, in particular of a knife. A blade of the cutting tool comprises: a first side face and a second side face wherein the first side face contacts the second side face forming an acute angle and thereby a cutting edge. Sections of short microbevels (6, 7) and sections of long microbevels (4, 5) are arranged on the first side face and the second side face (2, 12) and form microtoothing arranged along the cutting edge and composed of a plurality of successive spaces (E), called cutting spaces (E). Cutting spaces (E) have at least a plurality of short microbevels (6, 7) arranged on the first side face (2) and at least a long microbevel (4, 5) arranged on the second side face (12) wherein the plurality of short microbevels (6, 7) are disposed on an opposite side of the blade as compared to a side where the long microbevel (4, 5) is disposed.

19 Claims, 5 Drawing Sheets

MICROTOOTHING FOR THE BLADE OF A CUTTING IMPLEMENT, PARTICULARY A KNIFE

BACKGROUND OF THE INVENTION

The invention relates to the field of cutlery and it has as an object a relief of a blade of a cutting tool, in particular of a knife.

There are known profiles which are arranged on the blades in order to level their cutting loss due to use and wear, which profiles are constituted by microtoothing which is composed of a plurality of incurved surfaces having parallel generatrixes, called microbevels, defining with one of the side faces of the blade a plurality of respective microcutters.

The inconvenience of the conventional microtoothing, formed by a plurality of short microbevels arranged along the blade, is based on the fact that the resulting short microcutters form a toothing which induces a shredding of the material to be cut up, where the tool therefore practically no longer cuts and, finally, being of a delicate use since the material, in particular meat, is soft.

In order to remedy this inconvenience, the efforts of the innovators has been directed to the refining of a microtoothing composed of short microbevels and of long microbevels, succeeding each other alternatingly, wherein the first shred the matter while the second cut the matter. One could in particular refer to the document EP-A-0220362 which describes a tool blade comprising such a microtoothing. In addition, the blade carries along its other face a bevel for reinforcing its cutting characteristic.

The result obtained is satisfying with regard to the improvement of the performance of the tool for cutting the matter but retains nevertheless another general drawback of microtoothed tools, namely to make their utilization delicate based on the presence of the microbevels which induce a tendency of the blade to incline itself by turning its blade edge toward the microbevelled face.

In addition, tools are known which carry a microtoothing composed of a plurality of short microcutters, successively formed by the short microbevels arranged respectively oppositely on each one of the side faces of the blade, in order to confer to the tool a natural stability during the time of its utilization.

The use of this type of tool, which is of relatively ancient origin, has been rapidly abandoned because of its high manufacturing cost, brought about by the difficulty of placing oppositely the microbevels arranged on the one and the other face of the blade, resulting in an unsatisfactory cut based on the cutter absence on the blade.

SUMMARY OF THE INVENTION

The object of the invention is to furnish a profile, of the type microtoothing, for a cutting tool, in particular a knife, which overcomes the aforesaid problems by conferring to the tool an optimum cutting and carving performance and a natural equilibrium of forces during its utilization.

Starting with the aforesaid analysis of the applicant, the ingenuity of the applicant has directed the applicant to overcome the prejudices and to break the attitudes and habits taken in this field in order to carry his conception and manufacturing efforts of a blade of a cutting tool onto a microtoothing composed of a succession of microcutters formed of short microbevels and of long microbevels, successively alternated and arranged on each of the side faces of the blade, in such a way that the tool has in a space, called cutting space, not only the short microcutters for shredding but also at least one long microcutter for cutting, arranged on both sides of the edge of the blade in order to confer to the tool a natural stability during the time of its utilization. Although the manufacture is more costly based on the delicate setting of the microbevels of one face of the blade with respect to those of the other face during the manufacture of the microtoothing, such a tool proves in a surprising manner to be competitive based on its optimum cutting quality and its ease of use.

In following his inventive step, the applicant has worked out a microtoothing where the short microbevels and the long microbevels, arranged on one of the faces of the blade, are preferably offset with respect to those arranged on the other side of the blade, which means that to one plurality of short microcutters, arranged on the one of the faces, corresponds at least one long microcutter, arranged on the other face of the blade, in such a way that each of said cutting spaces has short microbevels and at least one long microbevel, arranged respectively on both sides of the edge of the blade.

In other words and according to the invention, a blade of a cutting tool, in particular a knife, of the kind of blade comprising a profile, called microtoothing, composed of a plurality of incurved surfaces having parallel generatrixes, where the said surfaces, called microbevels, define together with one of the side faces of the blade a fraction of its edge, called microcutter, longer or shorter depending on the form of the directrix surface, wherein the profile comprises at least two types of distinct microbevels, as a function of the length of the microcutters which they define and which are successively disposed in alternation such that a plurality of microcutters, formed by a plurality of short microbevels, composing a section, called short microbevel section, alternate with at least one long microbevel, forming a section, called long microbevel section, is mainly characterized in that said short microbevel sections and long microbevel section are arranged on each of the side faces of the blade, wherein the microtoothing arranged along the blade is composed of a plurality of successive spaces, called cutting spaces, wherein each of the cutting spaces comprises microbevels arranged on both sides of the blade edge, which include at the same time at least a plurality of short microbevels and at least one long microbevel. In other words, the cutting spaces comprise each at least a plurality of short microbevels and at least a long microbevel respectively arranged on any one at least of the side faces of the blade.

From these arrangements results both a natural stability of the tool during its utilization based on the presence of microbevels arranged on both sides of the edge of the blade and an optimum capacity of the tool for cutting and carving based on the cumulative presence in one and the same cutting space of microcutters formed by short microbevels for shredding the matter and at least one long microbevel for cutting the matter.

Preferably and in order to perfect the result obtained by the invention, to at least one portion of a long microbevel along the side face of the blade corresponds a plurality of short microbevels of the other side face of the blade, wherein the alternation of the plurality of short microbevels with at least one long microbevel provided on one of the faces of the blade being offset relative to an alternation of a plurality of short microbevels with at least one portion of a long microbevel provided on the other face of the blade, wherein the said alternations can either be the same or different such that a same cutting space comprises respectively on both sides of the edge of the blade a plurality of short microbevels and at least one portion of a long microbevel.

It will be understood that one plurality of short microbevels arranged on one of the faces of the blade can correspond on the other face of the blade either to a same plurality of short microbevels, to at least one long microbevel, to a portion of a long microbevel, or to a plurality of short microbevels and at least one portion of a long microbevel, and that the successive alternations of long microbevels and of short microbevels arranged on one of the faces can be, relative to the ones arranged on the other face of the blade, either identical or different, or opposite, or offset.

The present invention will be better understood and the relevant details will appear from the description which will made of preferred embodiments of realization of the invention, relative to the figures of the annexed sheets, in which

DETAILED DESCRIPTION OF THE PREFERRED EMBODIMENTS

Figure 1A:
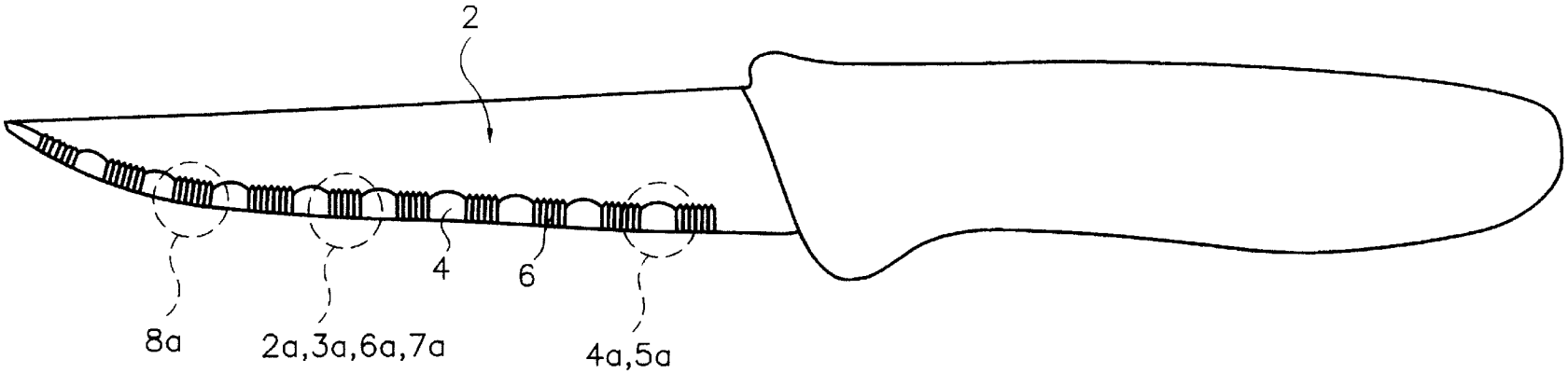
FIGS. 1*a*, 1*b* show a view of a blade furnished with a microtoothing.
Figure 1B:
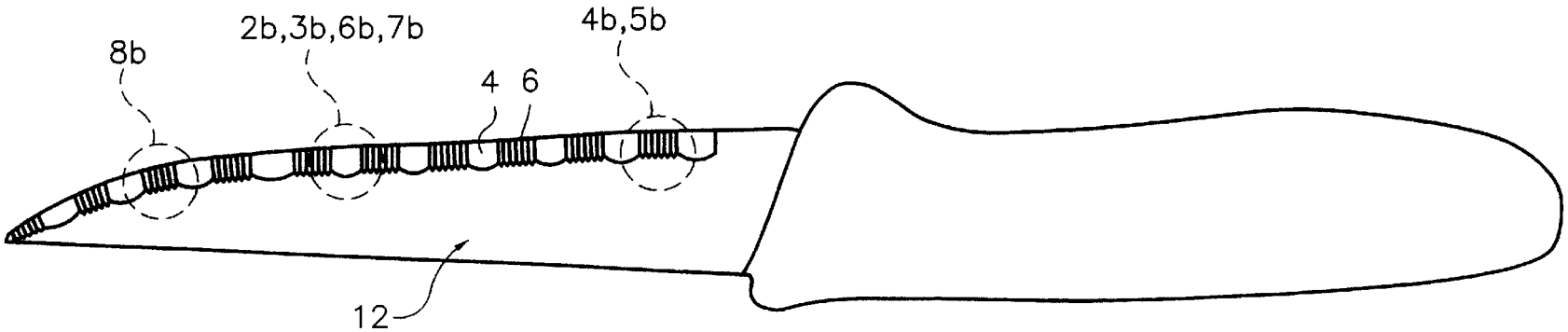

A knife blade is furnished according to FIGS. 1*a*, 1*b* on one of its faces 2 with a microtoothing extending along its edge, wherein said microtoothing is composed-of distinct and alternating microbevels 4 and 6 of different length, which define together with the face 2 of the blade a plurality of microcutters 8 and 10 of a respective length.

Different possibilities of construction of an invention profile are shown in FIGS. 2*a*, 2*b*, 3*a*, 3*b*, 4*a*, 4*b*, 5*a*, 5*b*, 6*a*, 6*b*, 7*a*, 7*b*, 8*a*, and 8*b*.

By the term section P1, P3 will be understood the regrouping of the neighboring microbevels of the same type, i.e. of the long microbevels, such as 4 or also 5 and by the term section P2, P4 the regrouping of the short microbevels, such as 6 or also 7, and by the cutting space E1 each of the successive sequences having a plurality of short microbevels 6, 7 and at least one long microbevel 4, 5.

In a general fashion, the blade comprises, arranged on each one of its side faces 2 and 12, a succession of alternated microbevels 4, 6 and 5, 7 of different length, i.e. short and long. The sections of short microbevels and of long microbevel are preferably offset from one face to the other such as illustrated in FIGS. 2*a* to 7*a*.

One observes the superpositioning, i.e. the accumulation in a same cutting space of the blade, at the same time of short microcutters 10 formed by corresponding microbevels 6 and 7, and of at least one portion of long microcutter 8, formed by a corresponding microbevel 4 or also 5.

Figure 2A:
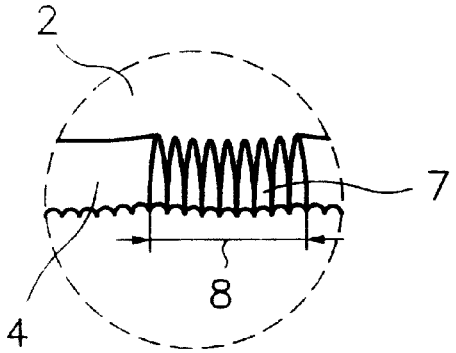
FIGS. 2*a*, 2*b*, 3*a*, 3*b*, 4*a*, 4*b*, 5*a*, 5*b*, 6*a*, 6*b*, 7*a*, 7*b*, 8*a*, and 8*b* are details of the cutter of a blade furnished with a profile according to different respective and preferred forms of realization of the invention.
Figure 3A:
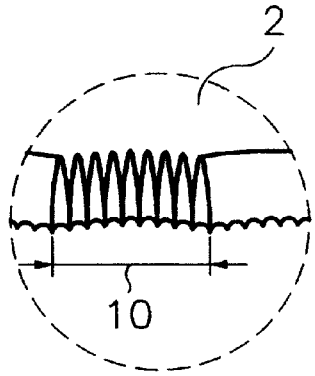
Figure 2B:
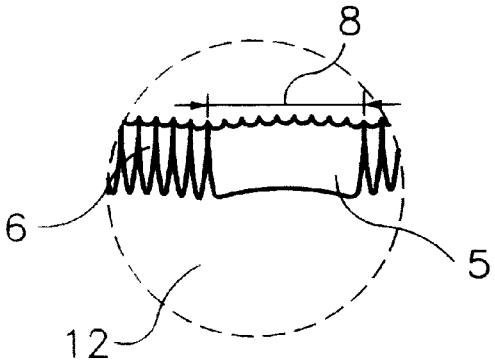
Figure 3B:
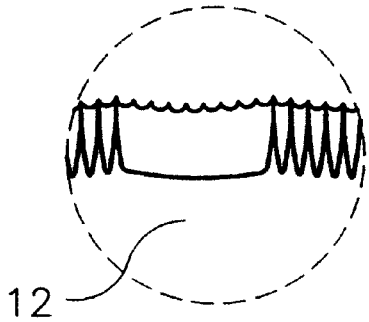
Figure 4A:
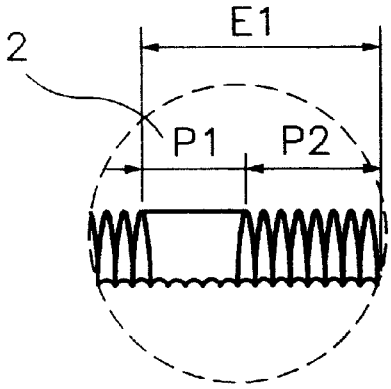
Figure 5A:
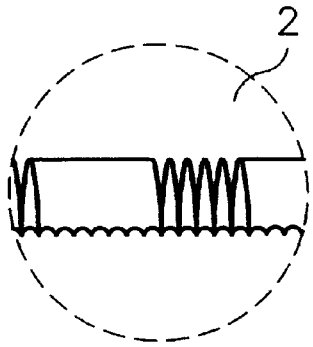
Figure 4B:
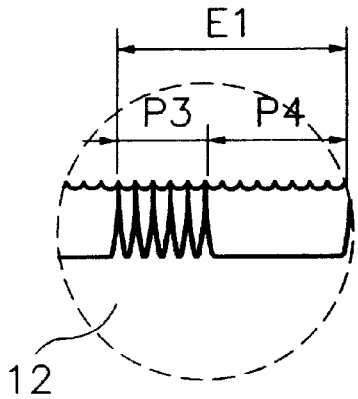
Figure 5B:
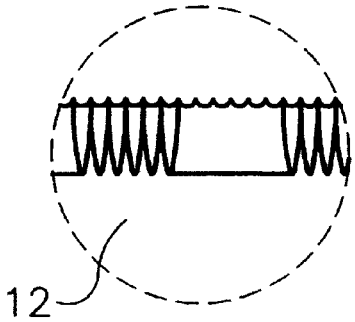
Figure 6A:
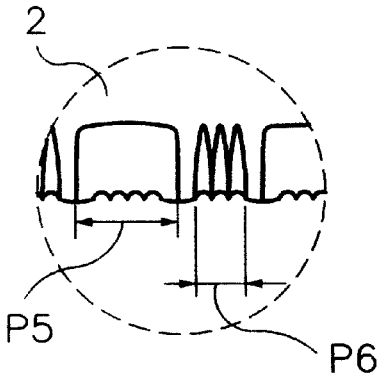

The sections of short microbevels and the sections of long microbevels are projecting with respect to the general orientation of the edge of the blade, as shown in FIGS. 2*a* and 2*b*, while according to FIGS. 3*a*, 3*b*, 6*a* and 6*b*, the sections of short microbevels and the sections of long microbevels are recessed with respect to the general orientation of the edge of the blade, and according to FIGS. 4*a*, 4*b*, 5*a*, 5*b*, 7*a*, 7*b*, 8*a*, and 8*b* the sections of short microbevels and the sections of long microbevels are aligned.

The sections of short microbevels P10, P12, P14 and the sections of long microbevels, P9, P11, P13 are of identical size according to FIGS. 5, 5*b*, 7*b* and 8*b*, which is contrary to those represented in FIGS 4*a*, 4*b*, 6*a*, 6*b*.

One observes in FIGS. 6*a*, 6*b*, 7*a*, 7*b* that one section P5, P7 of long microbevels 5, 4 of a side face of the blade corresponds to a section portion P6, P8 of short microbevels 6, 7 of the other side face of the blade, contrary to the other forms of realization of the illustrated invention profile, wherein one section of long microbevels 4, 5 of a side face of the blade corresponds to an equivalent section of short microbevels 6, 7 of the other side face of the blade.

One observes in a like manner and without deviating from the stated general principle of the invention that the types of sections can be of a number higher than two; for example, one long microbevel arranged on one of the faces of the blade can correspond to two sections of short microbevels of different length, or also one alternating sequence of short microbevels of different length; in other words, one section of short microbevels can be composed of at least two types of short microbevels of different and respective lengths. In the same way, one section of short microbevels, which itself can be composed of short microbevels of different lengths, can correspond to one section of several long microbevels, which can itself be composed of long microbevels of different length.

Figure 7A:
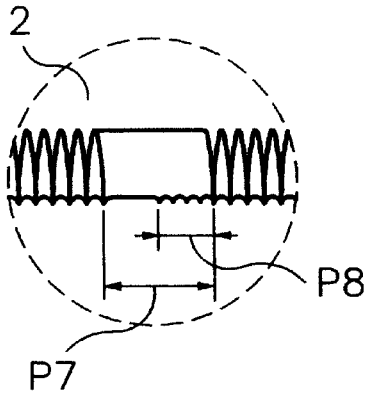
Figure 6B:
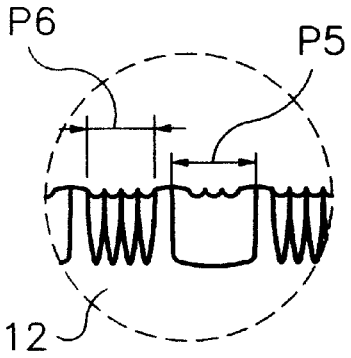
Figure 7B:
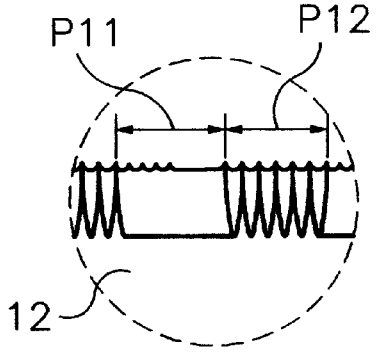
Figure 8A:
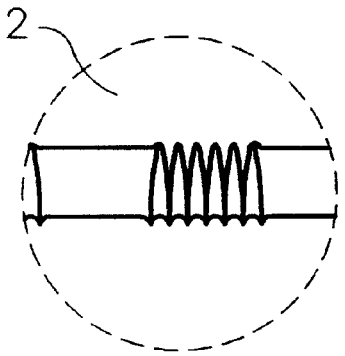
Figure 8B:
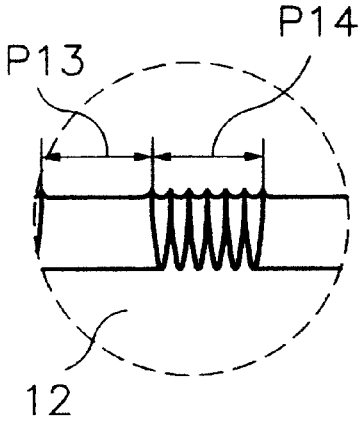

One observes also that in a like manner the length of the sections of short microbevels and of long microbevels arranged on one of the side faces of the blade and the length of the sections of short microbevels and of long microbevels arranged on the other face of the blade can be either identical or different; in other words, a first alternation of short microbevels and of long microbevels arranged on one of the faces of the blade corresponds to a second alternation of short microbevels and of long microbevels arranged on the other face of the blade, said first and second alternations can either be different or identical, and in the latter case, they can either be opposite to one another (FIGS. 8*a*, 8*b*), or they can be offset with respect to one another, wherein said offsetting can be arranged on the blade such that at least one long microbevel of one of the faces of the blade corresponds to a plurality of short microbevels of the other face of the blade (FIGS. 2*a*, 2*b* to 6*a*, 6*b*), or also such that at least one long microbevel of one of the faces of the blade corresponds at the same time to a plurality of short microbevels and at least a portion of a long microbevel of the other face of the blade (FIGS. 7*a*, 7*b*).

In a general way, it is understood that other combinations of sections are possible starting from the general principle of the invention, without deviating from the latter.

In addition, while the preferred forms of the embodiments of the present invention have been described and represented, it has to be understood that the scope of the latter is not limited to these forms, but that it extends to all profiles of a blade of a cutting tool comprising the characteristics set forth above.

We claim:

1. A blade of a cutting tool comprising:

a first side face; and a second side face wherein the first side face contacts the second side face forming an acute angle and thereby a cutting edge;

sections of short microbevels (6, 7) and sections of long microbevels (4, 5) arranged on the first side face and the second side face (2, 12) and forming microtoothing arranged along the cutting edge and composed of a plurality of successive spaces (E), called cutting spaces (E), having at least a plurality of short microbevels (6, 7) arranged on the first side face (2) and at least a long microbevel (4, 5) arranged on the second side face (12) wherein the plurality of short microbevels (6, 7) are disposed on an opposite side of the blade as compared to a side where the long microbevel (4, 5) is disposed.

2. A blade of a cutting tool the kind of blade having a profile, called microtoothing, composed of a plurality of incurved surfaces with parallel generatrixes, wherein said surfaces, called microbevels (4, 6), define together with one of the side faces (2) of the blade a fraction of its edge, called microcutter (8, 10), more or less long according to the form of a surface directrix, wherein the profile comprises at least two types of distinct microbevels (4, 6), depending on the length of the microcutters (8, 10) which they define, are disposed successively alternatingly, such that a plurality of microcutters (8, 10), formed by a plurality of short microbevels (6, 7) forming a section, called short microbevels, alternate with at least one long microbevel (4, 5) forming a section, called long microbevel, characterized in that said sections of short microbevels (6, 7) and of long microbevels (4, 5) are arranged on each one of the side faces (2, 12) of the blade, wherein the microtoothing arranged along the blade is composed of a plurality of successive spaces (E), called cutting spaces, wherein each of the cutting spaces (E) comprises microbevels on both sides of the edge of the blade, which comprise at least a plurality of short microbevels (6, 7) and at least one long microbevel (4, 5), i.e. cutting spaces (E) comprising each at least a plurality of short microbevels (6, 7) and at least a long microbevel (4, 5) respectively arranged on each one of the side faces (2) of the blade, and further characterized in that at least one portion of a long microbevel (4, 5) of a side face (2, 12) of the blade corresponds to a plurality of short microbevels (7, 6) of the other side face (2, 12) of the blade, wherein the alternation of the plurality of short microbevels (7, 6) with at least one long microbevel (4, 5) arranged on one of the faces (2, 12) of the blade is offset with respect to an alternation of a plurality of short microbevels (7, 6) with at least a portion of a long microbevel (4, 5) arranged on the other face (2, 12) of the blade (FIGS. 2 to 7), such that one same cutting space (E) carries respectively on both sides of the edge of the blade a plurality of short microbevels (7, 6) and at least one portion of a long microbevel (4, 5) (FIGS. 2 to 6, and FIG. 7).

3. Blade according to claim 2, characterized in that said sections (P) are projecting with respect to the general orientation of the edge of the blade (FIG. 2).

4. Blade according to claim 2, characterized in that said sections (P) are recessed with respect to the general orientation of the edge of the blade (FIGS. 3 and 6).

5. The blade according to claim 2, wherein section edges of the sections of short microbevels (6, 7) and of long microbevels (4, 5) are aligned with general orientation of the edge of the blade.

6. The blade according to claim 2, wherein the sections of short microbevels (6, 7) and of long microbevels (4, 5) are of identical size.

7. The blade according to any one of the preceding claims, wherein one section of long microbevels (4, 5) of the side faces (2, 12) of the blade correspond to one section of short microbevels (7, 6) of the other side face (2, 12) of the blade.

8. The blade according to any one of the claims 1 to 6, wherein a section of long microbevels (4, 5) of one side face (2, 12) of the blade corresponds to a section portion of short microbevels (7, 6) of the other side face (2, 12) of the blade.

9. The blade according to any one of the claims 1 through 6, wherein the section of short microbevels (6, 7) is composed of at least two types of short microbevels of different lengths.

10. The blade according to claim 1, wherein the sections of short microbevels (6, 7) and the sections of long microbevels (4, 5) are recessed with respect to general orientation of the cutting edge of the blade.

11. The blade according to claim 1, wherein the sections of short microbevels (6, 7) and the sections of long microbevels (4, 5) are aligned with a general orientation of the edge.

12. The blade according to claim 1, wherein the sections of short microbevels (6, 7) and the sections of long microbevels (4, 5) are of identical size.

13. The blade according to claim 2, wherein the first section and the second section are recessed relative to a general orientation of the cutting edge.

14. A blade of a cutting tool comprising a first side faces; and a second side face, wherein the first side face and the second side face are contacting each other to form a cutting edge;

a first section ending the first side face and the second side face at the cutting edge and disposed at the cutting edge as a plurality of short incurved bevels (6, 7);

a second section ending the first side face and the second side face at the cutting edge and disposed at the cutting edge as a long incurved bevel (4, 5), wherein the long incurved bevel (4, 5) is longer than one short bevel of the plurality of short bevels (6, 7) measured along the cutting edge, and wherein the first section and the second section are disposed alternatively along the cutting edge, and wherein the short incurved bevels (6, 7) are disposed on an opposite side of the blade as compared to the side of the blade where the long incurved bevels (4, 5) are disposed.

15. The blade according to claim 14, wherein at least a first portion of the first section of the first side face corresponds to a second portion of the second section of the second side face and at least a third portion of the first section of the second side face corresponds to a fourth portion of the second section of the first side face thereby forming a displacement of an alternation of first sections and second sections arranged on the first side face relative to an alternation of the first section and the second section arranged on the second side face.

16. The blade according to claim 15, wherein the first section and the second section project above a general orientation of the cutting edge.

17. The blade according to claim 15, wherein the second section of the first side face corresponds to the first section of the second side face, and wherein the second section of the second side face corresponds to the first section of the first side face.

18. The blade according to claim 15, wherein the first section is composed of at least two types of short microbevels of different lengths.

19. The blade according to claim 14, wherein a portion of the second section of one of the first side face and the second side face corresponds to the first section of the other one of the first side face and the second side face.

* * * * *